US012203369B2

(12) United States Patent
Al-Mousa et al.

(10) Patent No.: US 12,203,369 B2
(45) Date of Patent: Jan. 21, 2025

(54) MODIFIED WHIPSTOCK DESIGN INTEGRATING SMART CLEANOUT MECHANISMS

(71) Applicant: SAUDI ARABIAN OIL COMPANY, Dhahran (SA)

(72) Inventors: Ahmed A. Al-Mousa, Dhahran (SA); Linlin Wang, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 71 days.

(21) Appl. No.: 18/159,981

(22) Filed: Jan. 26, 2023

(65) Prior Publication Data

US 2024/0254835 A1 Aug. 1, 2024

(51) Int. Cl.

| | |
|---|---|
| ***E21B 7/06*** | (2006.01) |
| ***E21B 29/06*** | (2006.01) |
| ***E21B 34/02*** | (2006.01) |
| ***E21B 34/10*** | (2006.01) |

(52) U.S. Cl.

CPC ..... *E21B 7/061* (2013.01); *E21B 29/06* (2013.01); *E21B 34/025* (2020.05); *E21B 34/101* (2013.01)

(58) Field of Classification Search

CPC ..... E21B 7/061; E21B 29/06; E21B 34/10; E21B 34/101

See application file for complete search history.

(56) References Cited

U.S. PATENT DOCUMENTS

| | | | | |
|---|---|---|---|---|
| 2,105,721 | A * | 1/1938 | Cutrer | E21B 7/061 175/83 |
| 2,196,528 | A * | 4/1940 | Hughes | E21B 7/061 175/81 |
| 3,433,313 | A | 3/1969 | Brown | |
| 5,911,275 | A * | 6/1999 | McGarian | E21B 7/061 166/117.6 |
| 6,695,056 | B2 | 2/2004 | Haugen et al. | |
| 9,863,214 | B2 | 1/2018 | Cronley | |
| 9,926,745 | B2 | 3/2018 | Bulloch et al. | |
| 2002/0170713 | A1 * | 11/2002 | Haugen | E21B 27/00 166/117.6 |
| 2007/0007000 | A1 * | 1/2007 | Dewey | E21B 10/62 166/55.7 |
| 2008/0185148 | A1 | 8/2008 | Carter et al. | |
| 2017/0335647 | A1 * | 11/2017 | Rodriguez | E21B 29/005 |
| 2020/0040683 | A1 | 2/2020 | Taylor, Jr. et al. | |
| 2020/0318433 | A1 * | 10/2020 | Dineen | E21B 47/024 |
| 2021/0372219 | A1 * | 12/2021 | Brown-Kerr | E21B 23/00 |

(Continued)

OTHER PUBLICATIONS

Thang010146, "Converting two way linear motion into one way rotation 6", Youtube, Published Nov. 29, 2016; Website: https://www.youtube.com/watch?v=4ziGR9ggO60.

*Primary Examiner* — Shane Bomar
(74) *Attorney, Agent, or Firm* — Osha Bergman Watanabe & Burton LLP

(57) ABSTRACT

A system includes a milling assembly with a mill bit and a drill string that mills a new wellbore section. The system further includes a whipstock assembly that is formed by a smart reamer that reams an obstruction in a wellbore, a whipstock that deflects the milling assembly away from the wellbore, and a bypass valve mechanism that controls a fluid flowing through the system. Within the system, the milling assembly is fluidly connected to the whipstock assembly.

18 Claims, 11 Drawing Sheets

(56) References Cited

U.S. PATENT DOCUMENTS

| | | | | |
|---|---|---|---|---|
| 2023/0272672 | A1* | 8/2023 | Al-Mousa | E21B 21/103<br>166/117.6 |
| 2023/0383604 | A1* | 11/2023 | Al-Mousa | E21B 7/061 |

* cited by examiner

MODIFIED WHIPSTOCK DESIGN INTEGRATING SMART CLEANOUT MECHANISMS

BACKGROUND

Porous rock formations contain hydrocarbon reservoirs below the surface of the earth, which contain hydrocarbon fluids. These hydrocarbon fluids are then extracted by production wells that are drilled into the hydrocarbon reservoirs. Production wells may be drilled vertically from the surface, deviated from vertical, or vertical to horizontal in order to access the subsurface hydrocarbon reservoirs effectively and efficiently.

A typical practice in well construction involves casing the wellbore with tubulars and cementing the tubulars in place. This isolates the well from the surrounding formations that may be prone to collapse or have undesirable hazards present, such as shallow gas. Generally, each section of the well is drilled by a mill bit that is attached to a drill string that extends from a drilling rig at surface to the bottom of the wellbore. The drill string and the mill bit are pulled out of the wellbore upon completion of drilling a section of wellbore, and a section of casing is deployed and cemented into place, creating isolation from the newly drilled formation.

Often in well construction it is necessary to alter an existing wellbore trajectory, a practice referred to as "side-tracking". Instances when side-tracking is typically utilized include, but are not limited to, failure of an existing wellbore, a need to avoid subsurface hazards (faults, shallow gas, etc.), planned multilateral wellbore wells, missed geological targets, and reuse of an existing wellbore that has depleted reservoir production. A longitudinal tubular body with an inclined plane, or "whipstock", is a device that is regularly installed to facilitate the altering of a wellbore trajectory. When deployed into the wellbore, the whipstock serves as a deflection surface or ramp to alter the trajectory of the mill bit and, thus, the wellbore.

SUMMARY

One or more embodiments of the present invention relate to a system that includes a milling assembly with a mill bit and a drill string that mills a new wellbore section. The system further includes a whipstock assembly that is formed by a smart reamer that reams an obstruction in a wellbore, a whipstock that deflects the milling assembly away from the wellbore, and a bypass valve mechanism that controls a fluid flowing through the system. Within the system, the milling assembly is fluidly connected to the whipstock assembly.

One or more embodiments of the present invention relate to a method that includes running a whipstock assembly that is fluidly connected to a milling assembly into a wellbore to a desired depth and reaming an obstruction in the wellbore with a smart reamer of the whipstock assembly. The method further includes controlling a fluid traveling through the whipstock assembly by a bypass valve mechanism of the whipstock assembly. In addition, the method includes deflecting the milling assembly away from the wellbore by a whipstock of the whipstock assembly and milling a new wellbore section away from the wellbore with a mill bit of the milling assembly.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Figure 1:
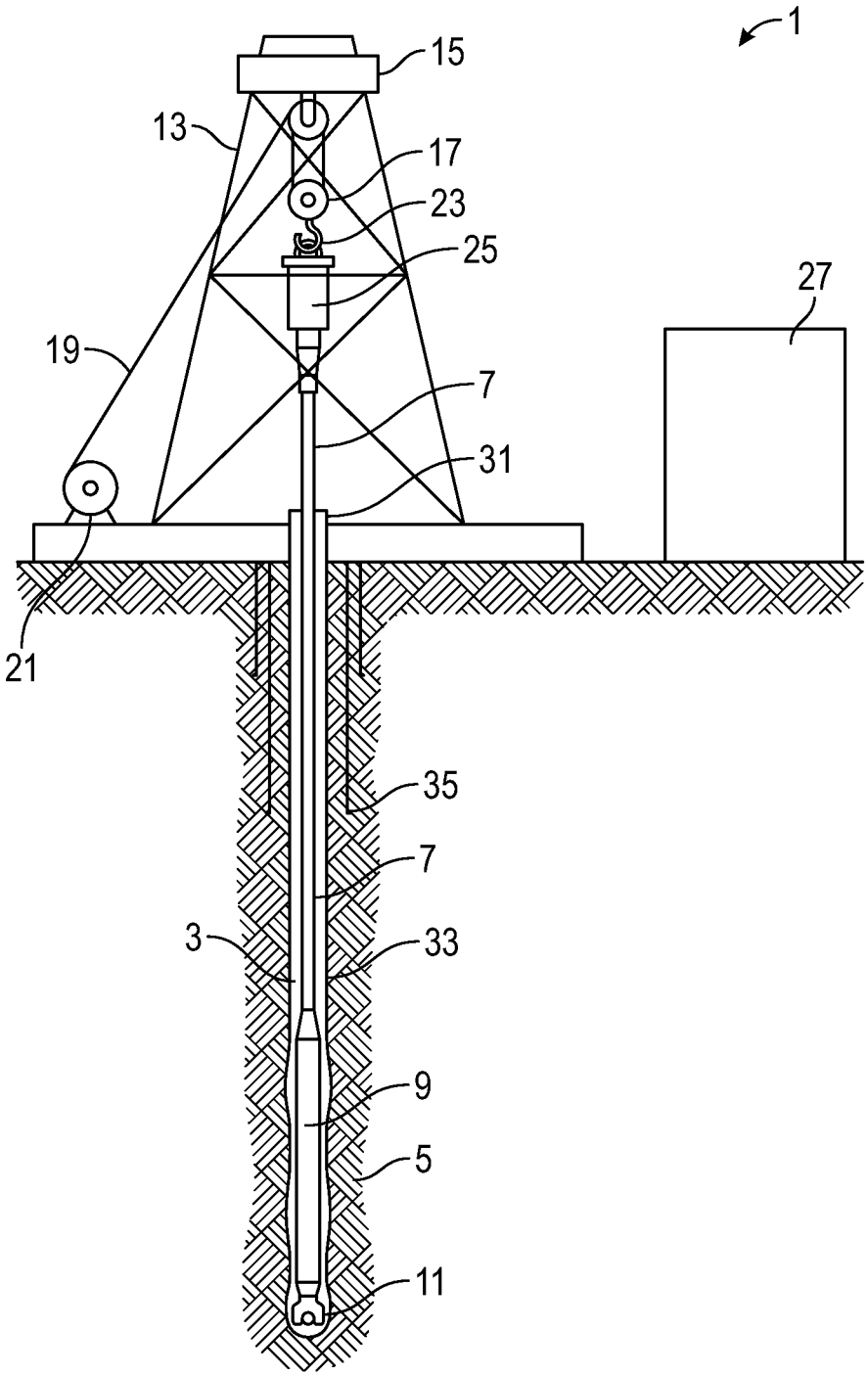
FIG. 1 illustrates an example drilling rig and wellbore in accordance with one or more embodiments of the present disclosure.

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a well. In this respect, the term "upper" denotes an element disposed closer to the surface of the Earth than a corresponding "lower" element when in a downhole position, while the term "lower" conversely describes an element disposed further away from the surface of the well than a corresponding "upper" element. Likewise, the term "axial" refers to an orientation substantially parallel to the well, while the term "radial" refers to an orientation orthogonal to the well.

As is commonly known in the art, whipstock assemblies are run downhole by a drill string in a cased wellbore. However, in some cases, the well contains an obstruction in the form of a cement plug, debris, the bottom of the wellbore, or another obstruction, which are often met prior to the whipstock assembly reaching its predetermined setting depth. In such instances, in order for the whipstock to reach the desired depth, the whipstock must be removed from the wellbore and one or more costly and time consuming clean out trips are made by a bottom hole assembly (BHA) to clear out the obstructions.

Accordingly, embodiments disclose herein describe systems and methods for both reaming an obstruction in a wellbore with a smart reamer and milling a new wellbore. In one or more embodiments, the system includes a milling assembly including a mill bit and a drill string, and a whipstock assembly including a smart reamer, a whipstock, and a bypass valve mechanism. The techniques discussed in this disclosure are beneficial in running a whipstock safely to a desired depth without any additional cleanout trips, thereby reducing additional rig time and associated costs. Further, the techniques discussed in this disclosure are beneficial as they generate an effective amount of rotational torque upon a reamer shoe without hydraulically actuating the reamer shoe or rotating the entire system. In addition, the techniques discussed in this disclosure are beneficial as they aide in removing debris within a wellbore during reaming of an obstruction, thereby preventing the system from getting stuck or prematurely setting at an undesired setting depth.

FIG. 1 illustrates an example of a well site 1. In general, well sites 1 have numerous different configurations. Therefore, the well site 1 is not intended to be limited with respect to the particular configuration of the drilling equipment depicted in FIG. 1. The well site 1 is shown as being on land. In other examples, the well site 1 could be shown as being offshore with the drilling being carried out with or without use of a marine riser. A drilling operation at a well site 1 includes drilling a wellbore 3 into a subsurface of various formations 5. In order to drill a new section of wellbore 3, a drill string 7 is suspended within the wellbore 3. The drill string 7 includes one or more drill pipes connected to form a conduit, and a BHA 9 disposed at the distal end of the conduit. For cutting into the subsurface rock, a mill bit 11 is utilized as a part of the BHA 9. Further, the BHA 9 includes measurement tools, such as a measurement-while-drilling (MWD) tool or a logging-while-drilling (LWD) tool, as well as other drilling tools that are not specifically shown but would be understood to a person skilled in the art.

A derrick structure 13 is used to suspend the drill string 7 in the wellbore 3. The top of the derrick structure 13 is mounted with a crown block 15. From the crown block 15, a traveling block 17 hangs down by means of a cable or drill line 19. One end of the drill line 19 is connected to a drawworks 21, which is a reeling device that adjusts the length of the drill line 19 so that the traveling block 17 is capable of moving up or down the derrick structure 13. The traveling block 17 includes a hook 23 that supports a top drive 25. The top drive 25 is coupled to the top of the drill string 7 and is operable to rotate the drill string 7. The drill string 7 is pumped with drilling fluid (commonly called mud) from a mud system 27. The mud flows into the drill string 7 through appropriate flow paths in the top drive 25. Details of the mud flow path have been omitted for simplicity but would be understood by a person skilled in the art.

During a drilling operation at the well site 1, in order to break rock, the drill string 7 is rotated relative to the wellbore 3 and weight is applied to the mill bit 11. In some cases, the mill bit 11 is rotated independently with a drilling motor. In other embodiments, the mill bit 11 is rotated using a combination of a drilling motor and the top drive 25 to rotate the drill string 7. Mud is pumped into the drill string 7 while the mill bit 11 cuts through the rock. The mud flows down the drill string 7 and exits through a nozzle in the mill bit 11 into the bottom of the wellbore 3. Once in the wellbore 3, the mud flows back up to a surface 31 in an annular space between the drill string 7 and the wellbore 3 carrying entrained cuttings to the surface 31. The mud with the cuttings is returned to the mud system 27 to be circulated back again into the drill string 7. Before pumping the mud again into the drill string 7, the cuttings are typically removed from the mud, and the mud is reconditioned as necessary.

Upon the retrieval of the drill string 7, the BHA 9, and the mill bit 11 from the wellbore 3, the drilling operations are complete. Alternatively, the production casing operations commence in some embodiments of wellbore 3 construction. In such instances, a casing 33 made up of one or more larger diameter tubulars that have a larger inner diameter than the drill string 7, but a smaller outer diameter than the wellbore 3, is lowered into the wellbore 3 on the drill string 7. The casing 33 is designed to isolate the internal diameter of the wellbore 3 from the adjacent formation 5. Once the casing 33 is positioned, the casing 33 is set and cement is pumped down through the internal space of the casing 33, out of the bottom of a casing shoe 35, and into the annular space between the wellbore 3 and the outer diameter of the casing 33. This creates the desired isolation between the wellbore 3 and the formation 5 and secures the casing 33 in place. Afterwards, the drilling of the next section of the wellbore 3 begins.

Figure 2:
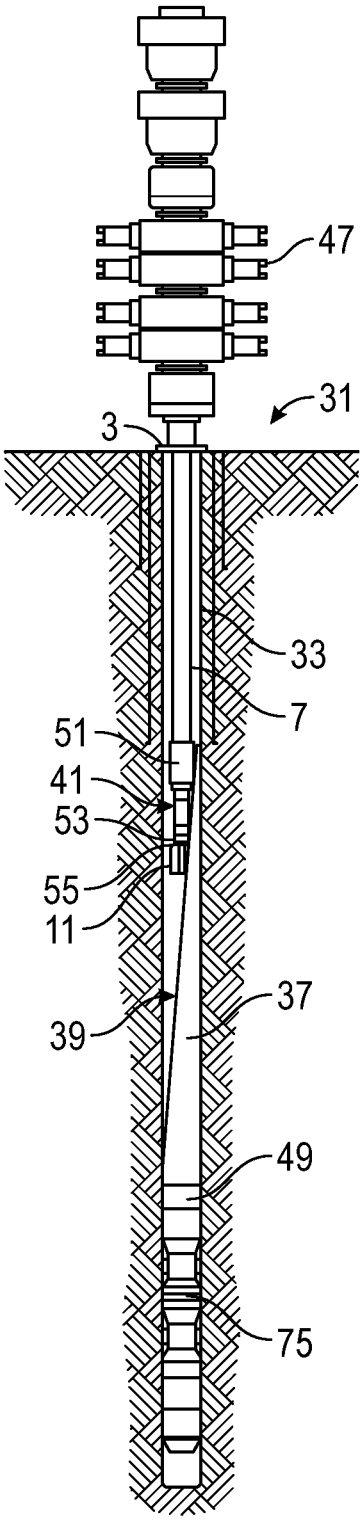
FIGS. 2 and 3 show diagrams depicting the operational sequence of setting a whipstock in accordance with one or more embodiments of the present disclosure.

As shown in FIG. 2, a whipstock 37 is deployed when there is a need to alter the trajectory of the wellbore 3. In one or more embodiments a whipstock 37 includes a lower anchoring mechanism, an inclined deflection surface 39, and a releasable connection to a milling assembly 41 located at the top of the whipstock 37. The lower anchoring mechanism may be a hydraulic or mechanical anchor configured to be removable following a drilling operation, while the releasable connection may be a shear bolt or an equivalent shearing connection. The whipstock 37 and the milling assembly 41 are deployed into the wellbore 3 as an assembly during whipstock operations. The anchoring mechanism is activated and attaches the whipstock 37 to the inside surface of the casing 33 once the setting depth is reached.

Afterwards, a downward force to the whipstock 37 is applied from the drill string 7, severing the releasable connection, thereby releasing the milling assembly 41 and the mill bit 11 from the whipstock 37. Alternatively, the whipstock 37 is anchored in the wellbore 3 without being attached to the milling assembly 41 if the whipstock 37 is deployed in the wellbore 3 by a separate running tool. In either configuration, once placed, the whipstock 37 is anchored in the wellbore 3 independent of the milling assembly 41 such that the milling assembly 41 moves freely within the wellbore 3. As the mill bit 11 begins drilling, the deflection surface 39 of the whipstock 37 is used as a guide to deflect the mill bit 11 away from the existing wellbore 3 to begin drilling a new wellbore 45 of a different trajectory.

Figure 3:
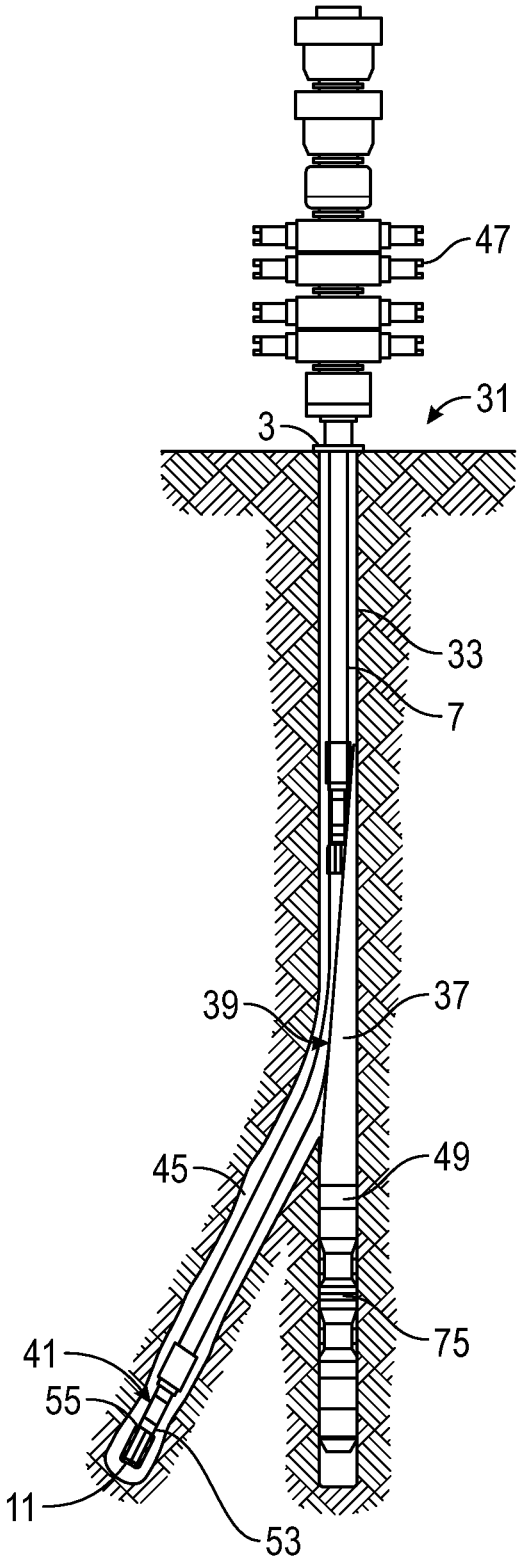

FIGS. 2 and 3 provide an overview of an operational sequence of setting a common whipstock 37 in accordance with embodiments disclosed herein. FIG. 2 illustrates a whipstock 37 that has been deployed on a drill string 7 and anchored to the casing 33 of the wellbore 3. The wellbore 3 includes an installed Blowout Preventer (BOP) 47. The BOP 47 is installed during whipstock operations while drilling a new wellbore 45 section and is considered safety critical equipment. The whipstock 37 includes a deflection surface 39 and a connection to an anchor via an anchor connection 49. The deflection surface 39 is an inclined, concave-shaped bar used to deflect a mill bit 11.

The mill bit 11 is designed for milling through metal or steel and is a fixed-style bit. Generally, in the oil and gas industry, when there is a need to "sidetrack," or change the trajectory of, a wellbore 3, this type of mill bit 11 is utilized to mill a window in the casing 33. The mill bit 11 is typically formed from tungsten carbide; however, one of ordinary skill in the art would appreciate that the mill bit 11 may be formed from steel, a high strength alloy, or equivalent, and may further be coated with a PDC layer.

Further, FIG. 2 depicts a milling assembly 41 that is attached to the whipstock 37 by a milling assembly connector 51. The milling assembly 41 includes a BHA connection 53, a drilling housing 55, and the mill bit 11. The milling assembly connector 51 is a force-limiting type connection that is designed to fail upon the application of a predetermined amount of applied force, such as a shear bolt, magnetic interlock, or other equivalent connection known to one of ordinary skill in the art. Alternatively, and as described above, the whipstock 37 is deployed in the wellbore 3 prior to a drilling operation by a separate running tool or assembly. Once the whipstock 37 is deployed, the running tool or assembly is removed from the wellbore 3 before the drilling operation begins.

FIG. 3 shows the milling operations of a new wellbore 45 section. The milling assembly connector 51 of FIG. 2 is sheared by applying a downward force to release the milling assembly 41 from the anchored whipstock 37. This milling assembly connector 51 may be a shear bolt or another suitable shearing device. The mill bit 11 is then redirected by the deflection surface 39 of the whipstock 37 and begins to mill a window in the casing 33, departing from the wellbore 3 and re-orienting the trajectory of the wellbore 3 into the new wellbore 45.

Figure 4:
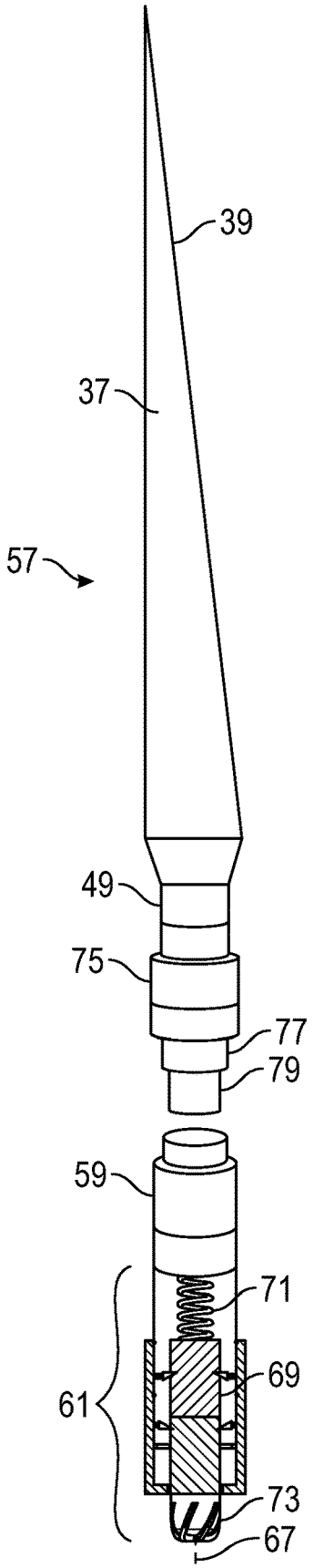
FIG. 4 shows a whipstock assembly in accordance with one or more embodiments of the present disclosure.

FIG. 4 illustrates a whipstock assembly 57 according to one or more embodiments, separated into the two sections: a lower portion and an upper portion. The lower portion includes a bypass valve mechanism 59 and a smart reamer 61. The bypass valve mechanism 59, formed of steel, is disposed at an upper end of the lower portion of the whipstock assembly 57. Disposed at an upper end of the bypass valve mechanism 59 is an opening that is connected to and receives fluid from the upper portion of the whipstock assembly 57. A plurality of valve openings 63 are situated at a lower end of the bypass valve mechanism 59. The fluid enters the bypass valve mechanism 59 through the opening and exits the system into the wellbore 3 through the plurality of valve openings 63 if a gate 65 of the bypass valve mechanism 59 is in the open position. The structure of the bypass valve mechanism 59 is further detailed in FIGS. 8 and 9, which show the bypass valve mechanism 59 with the gate 65 in an open position and closed position, respectively, in accordance with one or more embodiments of the present disclosure.

The bypass valve mechanism 59 and the smart reamer 61 are sequentially aligned on a same vertical axis 67 with the smart reamer 61 being disposed below the bypass valve mechanism 59. The smart reamer 61 includes a mandrel 69, a spring 71, and a reamer shoe 73 and is designed to clear obstructions within the wellbore 3 while lowering the system within the wellbore 3 to a desired depth by converting linear motion into rotational torque. The mandrel 69 is a grooved shaft and may be formed of a durable material such as steel. In addition, the mandrel 69 is disposed between and connected to the spring 71 and the reamer shoe 73. Further, the mandrel 69 is rotatable around the vertical axis 67 and serves to rotate the reamer shoe 73 in order to ream through obstructions.

The spring 71 is connected to the upper end of the mandrel 69 while the reamer shoe 73 is connected to the lower end of the mandrel 69. The spring 71 is a compression spring and may be formed of high-carbon, alloy, or stainless steel. Further, the spring 71 moves the mandrel 69 axially within the smart reamer 61 depending on forces acting upon the reamer shoe 73. When the system encounters an obstruction while being lowered within the wellbore 3, the obstruction applies a force against the reamer shoe 73. When the force is greater than the spring force of the spring 71, the spring 71 compresses and moves the attached mandrel 69, along with the reamer shoe 73, uphole within the smart reamer 61. Simultaneously, while the mandrel 69 moves uphole, the smart reamer 61 translates the linear motion of the mandrel 69 into rotational motion and rotates the reamer shoe 73. As such, the reamer shoe 73 begins to ream through the obstruction. As the reamer shoe 73 reams through the obstruction, the force of the obstruction acting upon the reamer shoe 73 weakens. When the force of the obstruction upon the reamer shoe 73 becomes less than the spring force of the spring 71, the spring 71 expands, thereby moving the mandrel 69 and reamer shoe 73 downhole within the smart reamer 61. Similarly, while traveling downhole within the smart reamer 61, the mandrel 69 converts linear motion into rotational torque, thereby continuing to actuate the reamer shoe 73.

The reamer shoe 73 is disposed at the downhole end of the smart reamer 61 and is made of PDC. The reamer shoe 73 is convex shaped with ledge riding capabilities and is employed to ream through obstructions at the downhole end of the wellbore 3. The obstruction may be created by sloughing of a wall of the wellbore 3 or as a result of the casing 33 pushing debris ahead of the bottom end of the casing 33 along the wellbore 3 until the debris forms abridge. The functions and structure of the smart reamer 61 is further detailed in FIGS. 5 and 6, which show the smart reamer 61 with the spring 71 in a relaxed position and a compressed position, respectively, in accordance with one or more embodiments of the present disclosure.

The upper portion of the whipstock assembly 57 is composed of a whipstock 37, an anchor connection 49, a whipstock anchor 75, a whipstock packer 77, and a piston 79. The whipstock 37 is a long steel casing disposed downhole and designed to deflect a mill bit 11 from the wellbore 3 with a deflection surface 39. The deflection surface 39 is a tapered, concave shaped bar located towards an upper end of the whipstock 37 that is used to deflect the mill bit 11 to alter the trajectory of the mill bit 11. The anchor connection 49 is commonly a hinge system design that connects the whipstock 37 to the whipstock anchor 75. The whipstock anchor 75, typically formed of high-strength alloy steel, secures the whipstock assembly 57 in the wellbore 3 by digging into the casing 33 when set. The whipstock packer 77 is often formed of elastomeric materials and acts as a seal, preventing any fluid from passing through. The piston 79 of the whipstock assembly 57, composed of steel, is designed to set the whipstock anchor 75 and whipstock packer 77 subsequent to a pressure reaction acting on the piston 79 created within the bypass valve mechanism 59.

Figure 5:
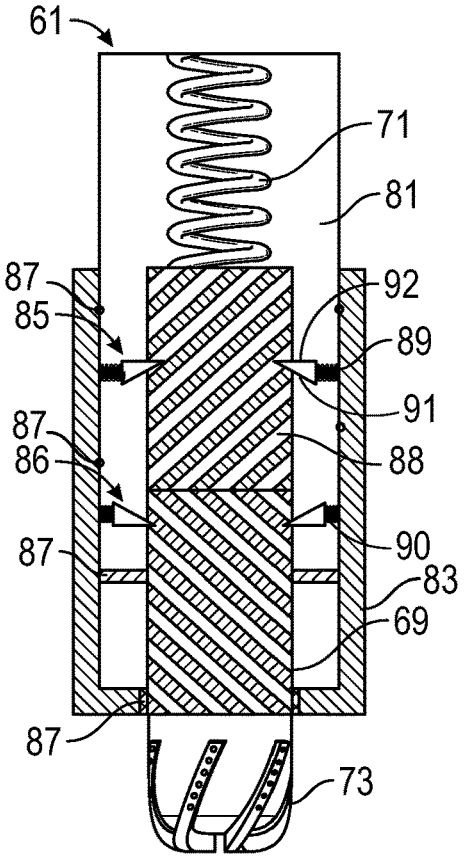
FIGS. 5 and 6 show a smart reamer with a spring in a relaxed and compressed position, respectively, in accordance with one or more embodiments of the present disclosure.
Figure 6:
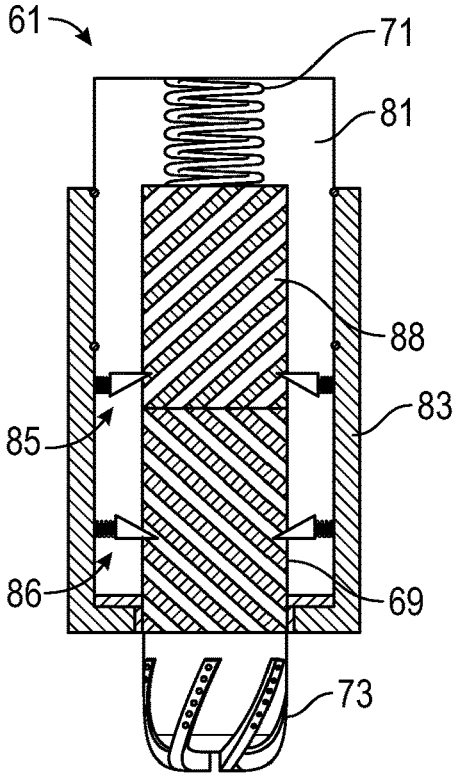

FIGS. 5 and 6 provide an overview of an operational sequence of the smart reamer 61, in accordance with one or more embodiments. As shown in FIG. 5, the smart reamer 61 further includes an inner casing 81, an outer casing 83, a upper pin ring 85, and a lower pin ring 86. The inner casing 81 is a tube formed of a durable material, such as steel. The spring 71 is disposed within an interior of the inner casing 81, and an upper end of the spring 71 is fixed to an upper end of the inner casing 81. In addition, the upper end of the mandrel 69 is also disposed within the interior of inner casing 81, while the lower end of the mandrel 69 and the reamer shoe 73 are situated outside of the inner casing 81.

Similar to the inner casing 81, the outer casing 83 of the smart reamer 61 is a tube formed of a durable material, such as steel. The outer casing 83 serves to protect the portion of the mandrel 69 extending outside of the inner casing 81 from debris or other elements within the wellbore 3. A lower end of the outer casing 83 may be attached to the lower end of the mandrel 69 or a connection piece disposed between the mandrel 69 and the reamer shoe 73. The outer casing 83 may have a length similar to or less than a length of the inner casing 81. Further, the outer casing 83 has a diameter greater than a diameter of the inner casing 81. In this way, as the mandrel 69 moves axially within the inner casing 81, the outer casing 83 may slide along an exterior of the inner casing 81.

The smart reamer may further include a plurality of seals 87. The plurality of seals 87 may be annular, elastomeric seals designed to prevent debris within the wellbore 3 from entering the smart reamer 61. Additionally, the plurality of seals 87 may be disposed between the inner casing 81 and the outer casing 83 in order to prevent fluid within the smart reamer 61 from exiting the smart reamer 61 through the space between the inner casing 81 and the outer casing 83. Further, the plurality of seals 87 may be disposed between the mandrel 69 and the inner casing 81 and between the mandrel 69 and the outer casing 83, thereby preventing fluid within the smart reamer 61 from exiting the smart reamer 61 above the reamer shoe 73, as well as preventing fluid within the wellbore 3 from entering the smart reamer 61.

In FIG. 5, the spring 71 of the smart reamer 61 is in the relaxed position. The spring 71 may be in the relaxed position prior to the system encountering an obstruction or subsequent to the reamer shoe 73 reaming through an obstruction. Here, a portion of the mandrel 69 extends beyond the lower end of the inner casing 81. As such, there is a space between the lower end of the inner casing 81 and the lower end of the outer casing 83. In FIG. 6, the spring 71 is compressed as a result of the system being pressed against an obstruction. Here, the lower end of the mandrel 69 and the reamer shoe 73 have moved closer towards the lower end of the inner casing 81 as the mandrel 69 traveled upwards within the inner casing 81. Accordingly, the outer casing 83 slid upward along the exterior of the inner casing 81, and the space between the lower end of the inner casing 81 and the lower end of the outer casing 83 reduced. When the spring 71 is fully compressed, the lower end of the outer casing 83 may abut against the lower end of the inner casing 81.

Furthermore, the mandrel 69 includes an upper section and a lower section. As shown in the non-limiting example of FIG. 5, grooves 88 along the upper section of the mandrel 69 are helical and extend in a right-handed or clockwise direction, and the grooves 88 of the lower section of the mandrel 69 are helical and extend in a left-handed or counterclockwise direction. As such, the mandrel 69 may embody a double helical gear or a herringbone gear. The upper pin ring 85 may be situated along the inner casing 81 in a position such that the upper pin ring 85 is only capable of interacting with the grooves 88 disposed along the upper section of the mandrel 69. Similarly, the lower pin ring 86 may be situated along the inner casing 81 in a position such that the lower pin ring 86 is only capable of interacting with the grooves 88 disposed along the lower section of the mandrel 69.

Figure 7:
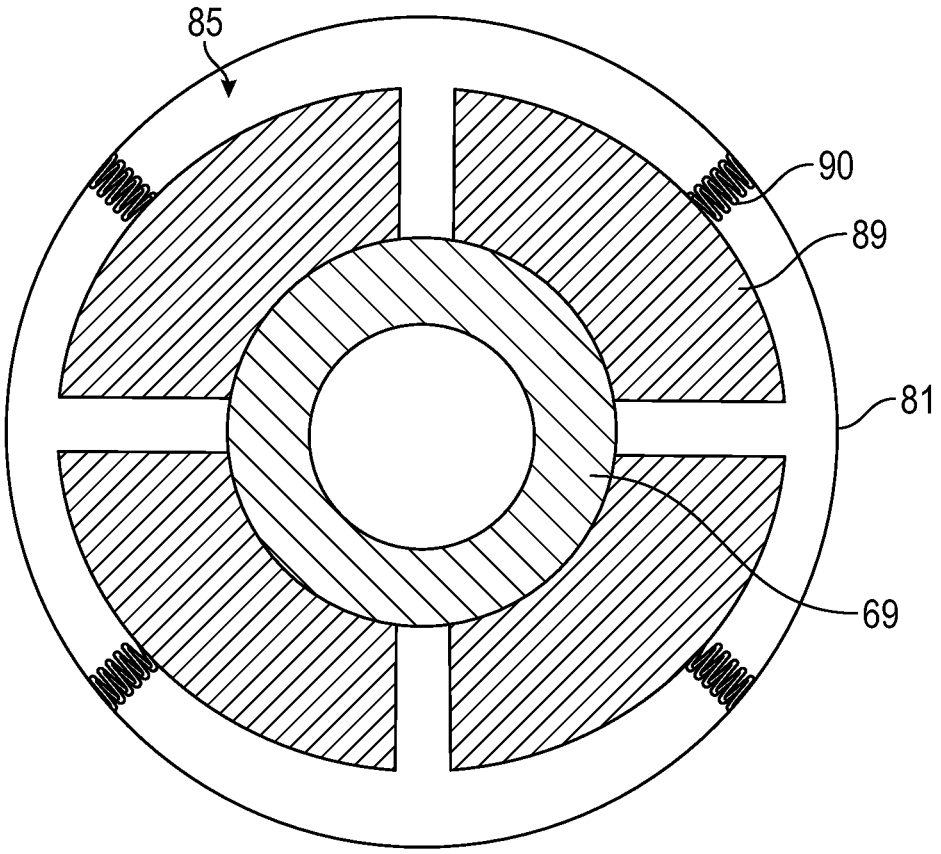
FIG. 7 shows a cross-sectional view of a smart reamer in accordance with one or more embodiments of the present disclosure.

FIG. 7 depicts a cross-sectional view of a smart reamer 61 in accordance with one or more embodiments of the present disclosure. While FIG. 7 illustrates an upper pin ring 85, the following description also applies to a lower pin ring 86. In this figure, the upper pin ring 85 is in contact with the upper section of the mandrel 69. Here, the upper pin ring 85 includes a plurality of pins 89. In the non-limiting example of FIG. 7, the upper pin ring 85 is formed of four pins 89. However, the upper pin ring 85 may be formed of a greater number of pins 89 or a lesser number of pins 89. The plurality of pins 89 may be formed of a durable and heat resistant material, such as steel, tempered steel, or a polymer. Further, an outer edge of each pin 89 that makes contact with the mandrel 69 is shaped complementary to the mandrel 69. In this way, each pin 89 of the plurality of pins 89 makes flush contact with the mandrel 69 when the plurality of pins 89 and mandrel 69 are pressed together.

Each pin 89 of the plurality of pins 89 of the upper pin ring 85 and the lower pin ring 86 is connected to an interior wall of the inner casing 81 by at least one pin spring 90. That is, at least one pin spring 90 is disposed between each pin 89 of the plurality of pins 89 and the inner casing 81. The pin springs 90 of the upper pin ring 85 and lower pin ring 86 are compression springs and may be formed of high-carbon, alloy, or stainless steel. Further, the pin springs 90 press the plurality of pins 89 against the mandrel 69, thereby keeping the plurality of pins 89 in contact with the mandrel 69.

As seen in FIGS. 5 and 6, the plurality of pins 89 of the upper pin ring 85 and the lower pin ring 86 may include a tapered side 91 and a non-tapered side 92. Here, in the embodiment depicted in FIGS. 5 and 6, the lower side of each pin 89 of the plurality of pins 89 of the upper pin ring 85 is the tapered side 91, while the upper side of each pin 89 of the plurality of pins 89 of the lower pin ring 86 is the tapered side 91.

An interaction between the plurality of pins 89 and the grooves 88 of the mandrel 69 forces the mandrel 69 to rotate as the mandrel 69 moves axially within the inner casing 81 due to a collision between the reamer shoe 73 and an obstruction. As seen in FIG. 6, when the smart reamer 61 is forced against an obstruction, the spring 71 compresses and the mandrel 69 travels upwards, axially, within the inner casing 81. Simultaneously, as the mandrel 69 travels upwards within the inner casing 81, the lower pin ring 86 rotates the mandrel 69. Here, the plurality of pins 89 of the lower pin ring 86 are pressed into the grooves 88 of the lower section of the mandrel 69 by the pin springs 90. While the mandrel 69 travels upwards within the inner casing 81, the non-tapered sides 92 of the plurality of pins 89 of the lower pin ring 86 abut against the walls of the grooves 88 of the lower section of the mandrel 69. The expanded pin springs 90 of the lower pin ring 86 force the non-tapered sides 92 of the plurality of the pins 89 of the lower pin ring 86 to stay in contact with the walls of the grooves 88 of the lower section of the mandrel 69 while sliding through the grooves 88 as the mandrel 69 is forced upwards within the inner casing 81. In turn, the mandrel 69 is forced to rotate.

In contrast, while the mandrel 69 is forced upwards within the inner casing 81, the upper pin ring 85 has no effect on the rotation of the mandrel 69. While the mandrel 69 is forced upwards within the inner casing 81, the tapered sides 91 of the plurality of pins 89 of the upper pin ring 85 is in contact with the grooves 88 of the upper section of the mandrel 69. As a result, the tapered sides 91 of the plurality of pins 89 of the upper pin ring 85 cause the plurality of pins 89 of the upper pin ring 85 to slide over the walls of the grooves 88 of the upper section of the mandrel 69, thereby permitting the plurality of pins 89 of the upper pin ring 85 to slide in and out of the grooves 88. Accordingly, as the plurality of pins 89 of the upper pin ring 85 slide in and out of the grooves 88 of the upper section of the mandrel 69, the pin springs 90 expand and compress, respectively.

Subsequently, when the smart reamer 61 is lifted in the wellbore 3 away from the obstruction, the spring 71 expands and the mandrel 69 travels downhole, axially, within the inner casing 81 (FIG. 5). Simultaneously, as the mandrel 69 travels downhole within the inner casing 81, the upper pin ring 85 rotates the mandrel 69. In this instance, the plurality of pins 89 of the upper pin ring 85 are pressed into the grooves 88 of the upper section of the mandrel 69 by the pin springs 90. While the mandrel 69 travels downhole within the inner casing 81, the non-tapered sides 92 of the plurality of pins 89 of the upper pin ring 85 abut against the walls of the grooves 88 of the upper section of the mandrel 69. The expanded pin springs 90 of the upper pin ring 85 force the non-tapered sides 92 of the plurality of the pins 89 of the upper pin ring 85 to stay in contact with the walls of the grooves 88 of the upper section of the mandrel 69 while sliding through the grooves 88 as the mandrel 69 is forced downhole within the inner casing 81, consequently forcing the mandrel 69 to rotate.

As the mandrel 69 is forced downhole within the inner casing 81, the lower pin ring 86 has no effect on the rotation of the mandrel 69. While the mandrel 69 is forced downhole within the inner casing 81, the tapered sides 91 of the plurality of pins 89 of the lower pin ring 86 is in contact with the grooves 88 of the lower section of the mandrel 69. As a result, the tapered sides 91 of the plurality of pins 89 of the lower pin ring 86 cause the plurality of pins 89 of the lower pin ring 86 to slide over the walls of the grooves 88 of the lower section of the mandrel 69, thereby permitting the plurality of pins 89 of the lower pin ring 86 to slide in and out of the grooves 88. As the plurality of pins 89 of the lower pin ring 86 slide in and out of the grooves 88 of the lower section of the mandrel 69, the pin springs 90 expand and compress, respectively. In this way, each pin spring 90 of the upper pin ring 85 and the lower pin ring 86 serves to move a corresponding pin 89 of the plurality of pins 89 radially within the inner casing 81 of the smart reamer 61.

Since the grooves 88 of the upper section of the mandrel 69 and the grooves 88 of the lower section of the mandrel 69 extend in opposite directions, the upper pin ring 85 and the lower pin ring 86 advantageously rotate the mandrel 69, and thus the reamer shoe 73, in a single direction. That is, the upper pin ring 85 and the lower pin ring 86 together translate the two-way linear motion of the mandrel 69 into a one-way rotational motion. Therefore, as the mandrel 69 moves up and down within the inner casing 81 due to a collision between the reamer shoe 73 and an obstruction, and the spring 71 compressing and expanding, the mandrel 69 rotates the reamer shoe 73 in a single direction. In some embodiments, the single direction may be the clockwise direction.

In addition to rotating the mandrel 69, the upper pin ring 85 and the lower pin ring 86 serve to keep the mandrel 69 axially in line with the inner casing 81. Further, the pin springs 90 and the plurality of pins 89 of the upper pin ring 85 and the lower pin ring 86 serve as dampers. As such, the upper pin ring 85 and the lower pin ring 86 reduce lateral vibrations of the mandrel 69 while the smart reamer 61 reams through obstructions.

Figure 9:
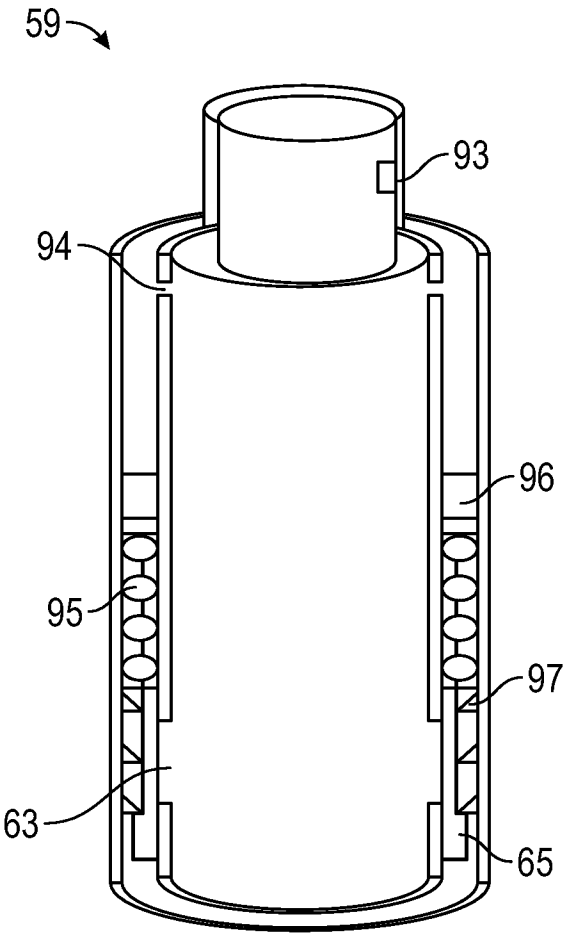
FIGS. 8 and 9 show a bypass valve mechanism with a gate in an open position and closed position, respectively, in accordance with one or more embodiments of the present disclosure.
Figure 8:
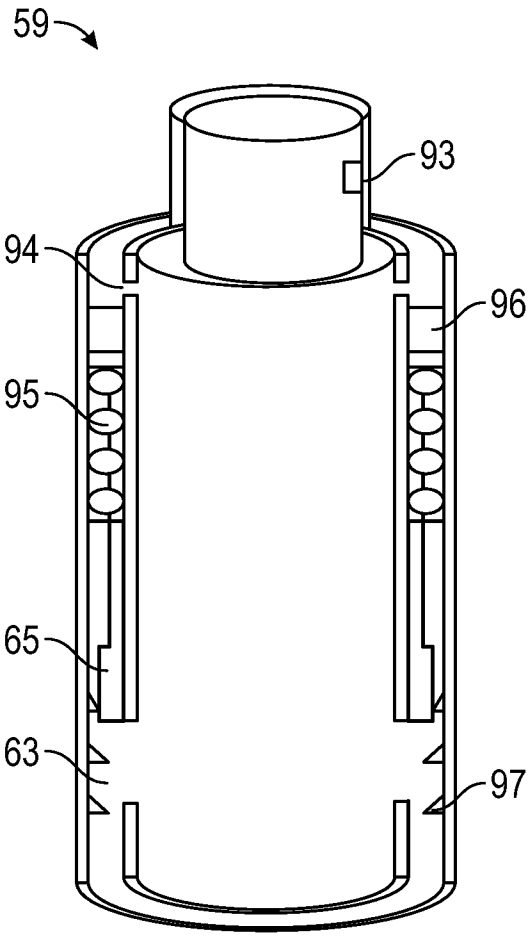

FIGS. 8 and 9 provide an overview of an operational sequence of closing the gate 65 of the bypass valve mechanism 59, in accordance with one or more embodiments. As shown in FIG. 8, the bypass valve mechanism 59 includes a sensor 93, pressure equalizing holes 94, and a gate assembly formed by a gate 65, an inner spring 95, and a pad ring 96 that are actuated to abut the gate 65 against a stop 97, thereby closing the valve openings 63. The sensor 93, a pressure sensor in communication with an operator located at the surface 31, is disposed at the upper end of the bypass valve mechanism 59 or attached to the bypass valve mechanism 59 as part of the upper whipstock assembly 57. The pad ring 96 is disposed on top of the inner spring 95 and forms a seal that allows fluid pressure to build on the upper surface of the pad ring 96. As shown in FIG. 8 the pad ring 96 is rigidly fixed to the inner spring 95, which is, in turn, rigidly fixed to the gate 65. Furthermore, each of the pad ring 96, the stop 97, and the gate 65 are disposed in a space between an interior and exterior wall of the bypass valve mechanism 59, which prevents lateral movement of the components.

The bypass valve mechanism 59 is depicted with the gate 65 in the open position in FIG. 8. When the bypass valve mechanism 59 is installed downhole in the wellbore 3 with the whipstock assembly 57, the gate 65 is positioned in the open position and disposed above the plurality of valve openings 63. The gate 65 is held in this position by an inner spring 95 and the stop 97. As such, while the gate 65 abuts against the upper end of the stop 97, the valve openings 63 are open. Conversely, as shown in FIG. 9, when the gate 65 is in the closed position, the gate 65 abuts against the bottom of the stop 97 such that the valve openings 63 are closed. In both the closed and open gate 65 positions, the inner spring 95 remains at rest and is not required to be in tension or compression in either position. Rather, the inner spring 95 is only compressed during the actuation of the gate 65.

Actuation of the gate 65 is driven by fluid pressure acting on the combination of the pressure equalizing holes 94, the inner spring 95, the sensor 93, and the pad ring 96. As noted above, the gate 65 is initially in an open position, allowing fluid to exit through the bypass valve mechanism 59 into the smart reamer 61 and to the wellbore 3 in order to lift the debris from the reamed obstruction to the surface 31. However, once an obstruction is cleared and the milling operation is no longer necessary, the gate 65 is closed to prevent fluid waste. In such instances, an operator at the surface 31 of the wellbore 3 increases the fluid pressure in the drill string 7, thereby creating fluid backflow that enters the pressure equalizing holes 94. This backflow acts on the top of the pad ring 96, which compresses the inner spring 95. The compressed inner spring 95 passively transmits the backflow pressure to the gate 65 which causes the gate 65 to be actuated against and through the stop 97, at which point the inner spring 95 is no longer compressed. As shown in FIG. 8, the stop 97 is formed as a series of gripping ledges that elastically deform to provide frictional interference between the gate 65 and the interior wall of the bypass valve mechanism 59. The stop 97 may be formed of rubber, nitrile, or other gripping materials commonly known in the art.

Accordingly, the actuation of the gate 65 depends upon the size of the pressure equalizing holes 94, the size of the valve opening 63, the amount of resistance provided by the stop 97, the surface area of the pad ring 96, and the spring constant of the inner spring 95, each of which are determined according to the potential backflow pressure that can be developed to ensure proper actuation of the gate 65. By way of example, for a given fluid pressure and a known dimension of the valve opening 63, the size and structure of the pad ring 96, the stop 97, the pressure equalizing holes 94, and inner spring 95 may be adjusted such that the backpressure created by increasing the pressure of the fluid above the given fluid pressure is sufficient to actuate the gate 65.

Because the stop 97 is embodied as a series of gripping ledges, it is further envisioned that cyclic backpressure forces the gate 65 to actuate over only one ledge per backpressure cycle such that the full actuation of the gate 65 depends on the duration or number of cycles of pressure applied to the pad ring 96. Specifically, when the operator increases the flow rate of a mud pump of the mud system 27, the resultant increase in fluid pressure creates the requisite backflow and the gate 65 is actuated through one of the ledges of the stop 97, thereby changing the size of the valve opening 63. This change in sizing causes a pressure buildup within the bypass valve mechanism 59 and reduces the amount of fluid entering the remainder of the whipstock assembly 57.

The change of fluid pressure in the bypass valve mechanism 59 is conveyed to an operator through the sensor 93. Upon receiving information that the gate 65 has moved through the first ledge of the stop 97, the operator continues the operation by raising the pressure again (to actuate the gate 65 through a subsequent ledge) or retaining the same pressure, in which case the gate 65 remains in position. Thus, the number of ledges of the stop 97 determines the number of pressure cycles required to actuate the gate 65. By way of nonlimiting example, and as shown in FIGS. 8 and 9, the number of ledges may be three or more.

While the above description is directed towards an operator monitoring the pressure drop in cycles to actuate the gate 65 through each individual ledge of the stop 97, it is contemplated that the operator may actuate the gate 65 through every ledge of the stop 97 without waiting to monitor a pressure change in the bypass valve mechanism 59. In this case, a prerequisite pressure is established that is greater than initial pressure and the pressure differential created by changing the size of the valve openings 63. During operation, when an operator wishes to actuate the gate 65 such that the gate 65 is actuated through every ledge of the stop 97 without adjustment, the operator adjusts the backpressure of the system to match the prerequisite pressure. As a result, the backpressure developed in the bypass valve mechanism 59 overcomes the initial pressure and the pressure differential(s) created by changing the size of the valve openings 63 to such a degree that the gate 65 is actuated through each ledge of the stop 97 without delay.

Figure 10:
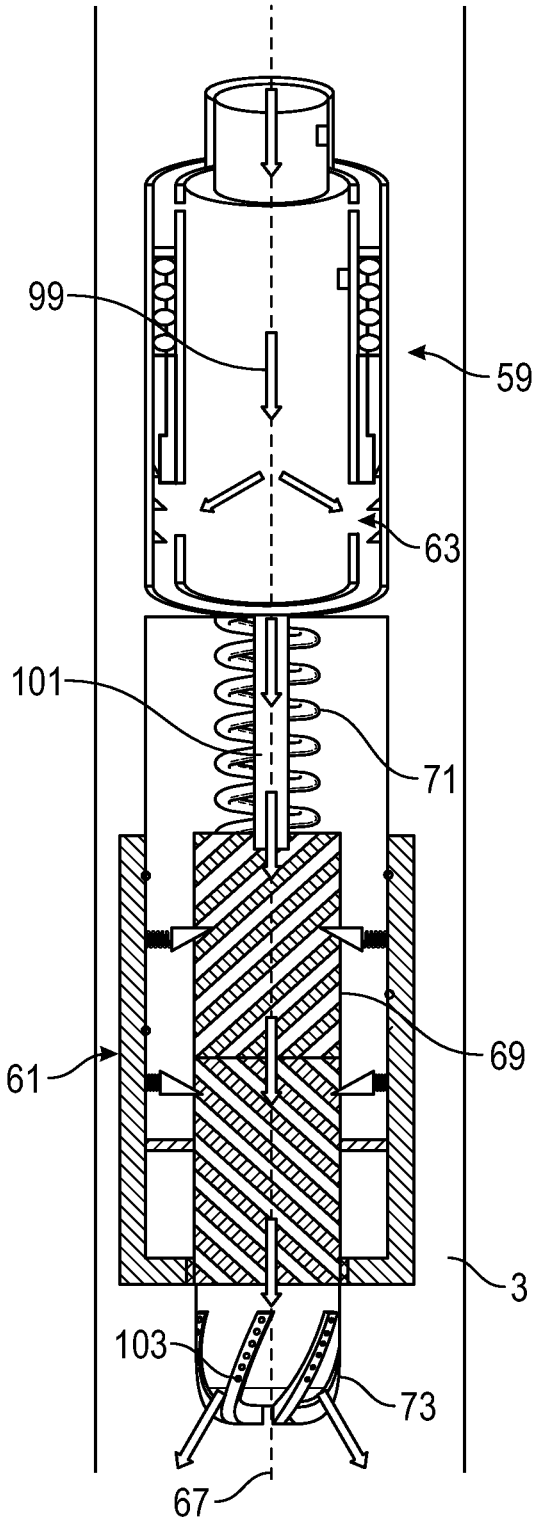
FIG. 10 shows a lower portion of the whipstock assembly in accordance with one or more embodiments of the present disclosure.

FIG. 10 illustrates the internal fluid path 99 through the lower portion of the whipstock assembly 57 in accordance with one or more embodiments. In this figure, the gate 65 of the bypass valve mechanism 59 is in the open position. The fluid enters the wellbore 3 after exiting the bypass valve mechanism 59 through the plurality of valve openings 63 and a space between the interior and exterior wall of the bypass valve mechanism 59. In this embodiment, the upper end of the inner casing 81 of the smart reamer 61 is connected to the lower end of the exterior wall of the bypass valve mechanism 59.

Further, in this embodiment, a fluid pathway 101 is located along the vertical axis 67. The fluid pathway 101 may be a fluid line formed of a polymer tubing or a rigid tube formed of a durable, noncorrosive polymer or metal. The fluid pathway 101 extends from the bypass valve mechanism 59 to the reamer shoe 73 of the smart reamer 61, passing through the interior of the spring 71 and mandrel 69. Here, when the gate 65 of the bypass valve mechanism 59 is open, fluid traveling through the bypass valve mechanism 59 exits the bypass valve mechanism 59 through the space between the interior and exterior wall of the bypass valve mechanism 59 in order to enter the fluid pathway 101. Next, fluid travels through the smart reamer 61, within the fluid pathway 101, to the reamer shoe 73. In this embodiment, the reamer shoe 73 includes a plurality of flow ports 103, or openings, that the fluid passes through in order to exit the whipstock assembly 57 and enter the wellbore 3. The fluid enters the wellbore 3 with enough pressure to assist in clearing debris dislodged while the reamer shoe 73 reams the obstruction and returns to the surface 31 in the annular space between the system and the wellbore 3 with the debris entrained therein. Additionally, the fluid exiting the reamer shoe 73 may lubricate and cool the reamer shoe 73 while the reamer shoe 73 reams through the obstruction.

Figure 11:
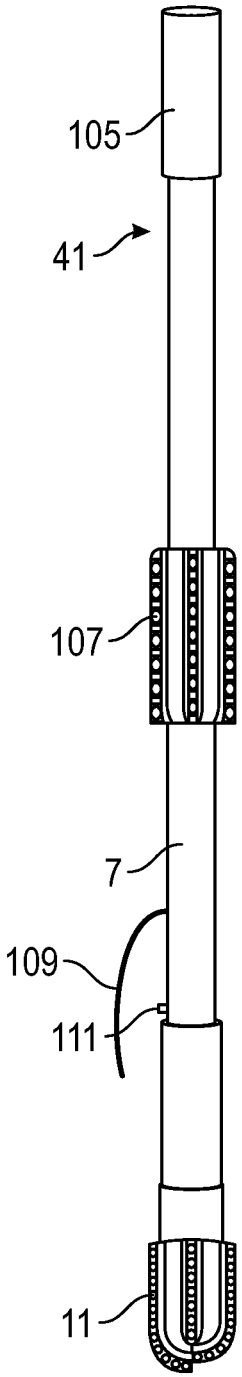
FIG. 11 shows a milling assembly in accordance with one or more embodiments of the present disclosure.

FIG. 11 shows the milling assembly 41 according to one or more embodiments. The milling assembly 41 includes the drill string 7, a coupling 105, a mill bit 11, a stabilizer 107, a fluid transfer line 109, and a temporary connection to the whipstock assembly 57. The coupling 105 is designed to couple pieces of the drill string 7 together to form a longer conduit and is formed of steel. The mill bit 11 is disposed at the bottom end of the milling assembly 41 and is temporarily attached to the whipstock assembly 57 prior to the whipstock assembly 57 setting. Once detached from the whipstock assembly 57, the mill bit 11 mills through the casing 33 of the wellbore 3 and creates a new wellbore 45 parallel to the deflection surface 39 of the whipstock assembly 57 by milling through the formation 5. While milling, the stabilizer 107, disposed on the drill string 7 above the mill bit 11, minimizes torque and drag on the drill string 7 and reduces damage to a wall of the new wellbore 45. The stabilizer 107 is constructed of multiple spiral ribs formed of high-strength alloy steel. The milling assembly 41 is temporarily attached to the whipstock assembly 57 prior to the setting of the whipstock 37 by a shear bolt 111, magnetic interlock, or other equivalent connection. The shear bolt 111, magnetic interlock, or other equivalent connection is disposed above the mill bit 11 on the drill string 7 of the milling assembly 41.

Figure 12:
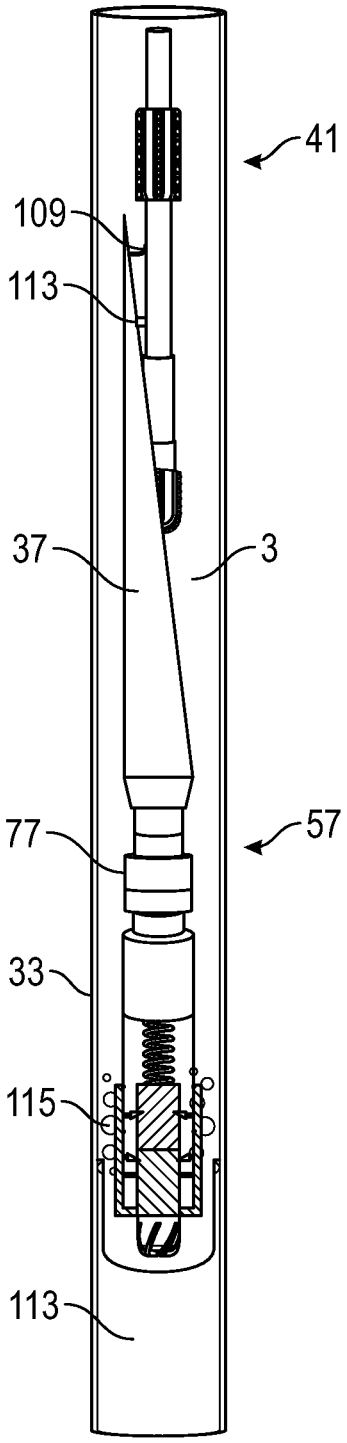
FIGS. 12-14 show diagrams depicting an operational sequence of the system in accordance with one or more embodiments of the present disclosure.
Figure 13:
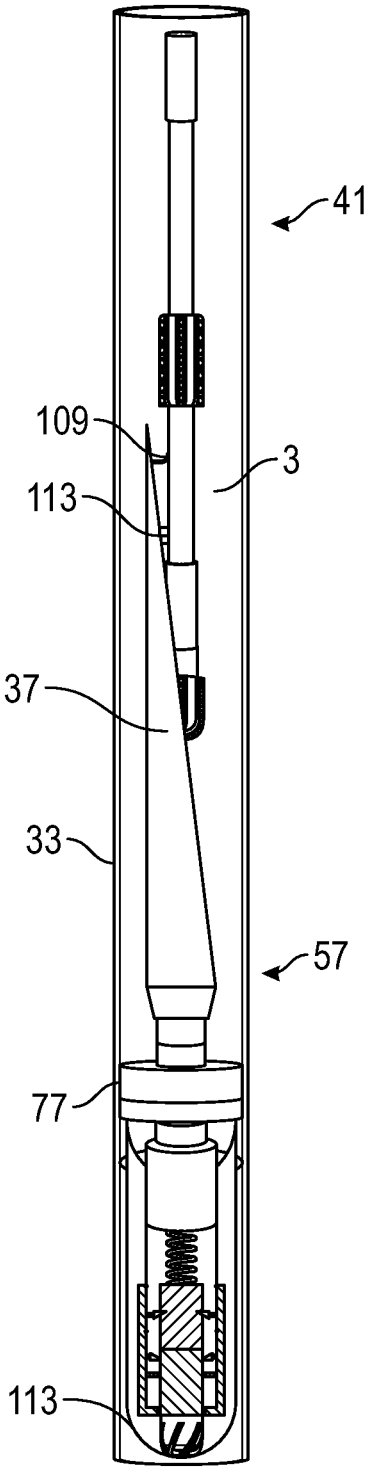
Figure 14:
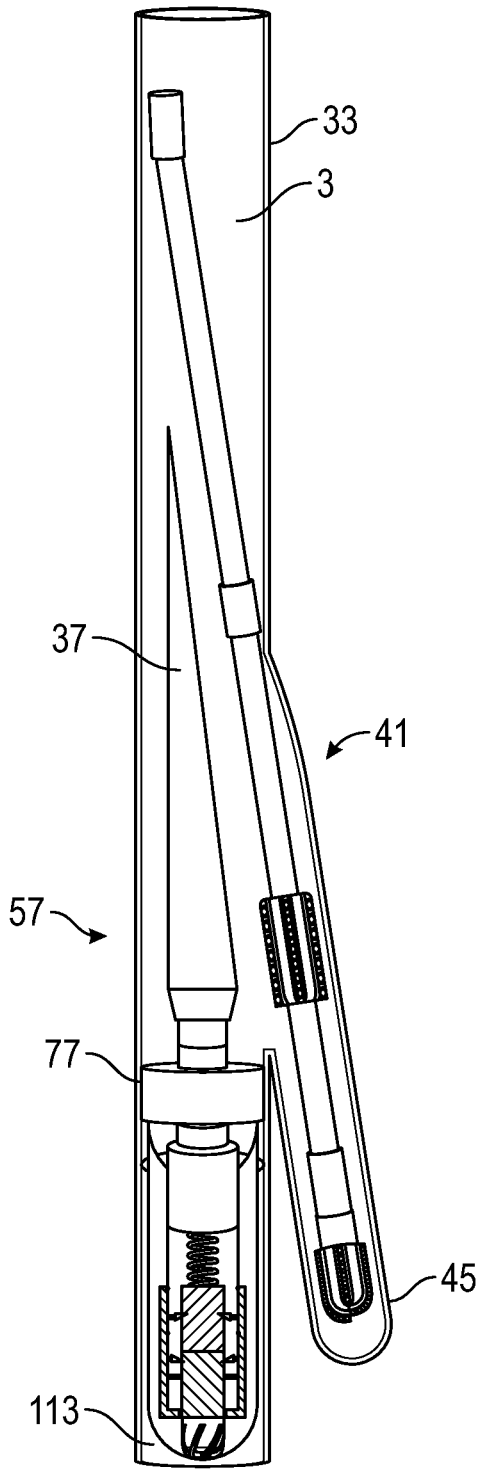

FIGS. 12-14 provide an overview of an operational sequence of reaming an obstruction 113, setting the whipstock assembly 57, and milling the new wellbore 45 according to one or more embodiments disclosed herein.

FIG. 12 illustrates the whipstock assembly 57 reaming through the obstruction 113 in the wellbore 3. Upon encountering an obstruction 113, the reamer shoe 73 is pressed against the obstruction 113 while the system is continued to be lowered within the wellbore 3. In turn, the mandrel 69 compresses the spring 71 within the inner casing 81 and the outer casing 83 slides along the exterior of the inner casing 81. While traveling upwards within the inner casing 81, the plurality of pins 89 interact with the grooves 88 of the mandrel 69, thereby rotating the mandrel 69. Consequently, the mandrel 69 rotates the reamer shoe 73, and the reamer shoe 73 begins to ream through the obstruction 113. The reamer shoe 73 is a convex shaped blade formed of PDC or a similarly strong material that is capable of breaking and clearing an obstruction 113.

When the system reaches an obstruction 113, the system may be lowered gradually within the wellbore 3 and press the reamer shoe 73 against the obstruction 113 in incremental weights. While the reamer shoe 73 is pressed against the obstruction 113, the spring 71 within the smart reamer 61 compresses and the mandrel 69 rotates the reamer shoe 73, causing the reamer shoe 73 to ream into the obstruction 113. Subsequent to the spring 71 fully compressing, the system is lifted upwards within the wellbore 3 until the spring 71 is back in the relaxed position. The process of lowering the system, pressing the reamer shoe 73 against the obstruction 113, and raising the system until the spring 71 is relaxed is referred to as a cycle.

In a non-limiting example, during the first cycle, the system may be lowered such that the reamer shoe 73 is pressed against the obstruction 113 with 5,000 lbs of force. If the obstruction is not cleared during the first cycle, the force of the reamer shoe 73 pressing against the obstruction 113 may be increased to 10,000 pounds (lbs) during a second cycle. The cycles may be continued with increasing incremental weights on the reamer shoe 73 until the obstruction 113 is cleared from the wellbore 3. During each cycle, the reamer shoe 73 may rotate at least 180 degrees when the system is pressed against the obstruction 113. Similarly, the reamer shoe rotates at least 180 degrees while the system is raised away from the obstruction 113.

If the obstruction 113 is minimal, then there is no need to employ the mud system 27 and pump fluid through the system. In this instance, the smart reamer 61 alone may clear the obstruction 113. However, if the obstruction 113 is not easily cleared, or debris 115 from the obstruction 113 begins to accumulate within the wellbore 3, the bypass valve mechanism may be utilized in order to guide fluid through the reamer shoe 73 to clear the wellbore 3 of debris 115. That is, fluid may be pumped into the drill string 7 from the surface 31 while the reamer shoe 73 reams through an obstruction 113 or subsequent to the system reaching the desired setting depth. The fluid flows from the milling assembly 41 to the whipstock assembly 57. Specifically, the fluid exits the milling assembly 41 through the fluid transfer line 109 and enters the whipstock assembly 57 through an opening (not shown) in the upper end of the whipstock 37. The fluid exits the whipstock assembly 57 through the bypass valve mechanism 59 and enters the wellbore 3. In the wellbore 3, the fluid flows back up to the surface 31 carrying debris 115 of the reamed obstruction 113.

As shown in FIG. 12, the milling assembly 41 is fluidly connected to the whipstock 37 by a fluid transfer line 109 that transfers fluid therebetween. The fluid transfer line 109 is connected to both the milling assembly 41 and the whipstock 37 using a connection with an auto shutoff feature, such as a quick disconnect with a gate, that closes the connection when the fluid transfer line 109 is not connected to either the milling assembly 41 or the whipstock assembly 57. As such, when the milling assembly 41 moves away from the whipstock 37 after the whipstock 37 is set in the wellbore 3, the fluid transfer line 109 is pulled out of the milling assembly 41 or the whipstock 37, efficiently severing the fluid connection thereof while preventing fluid leakage.

FIG. 13 depicts the system subsequent to the whipstock assembly 57 being set in accordance with one or more embodiments of the present invention. Following the desired depth being reached by the reamer shoe 73, the gate 65 of the bypass valve mechanism 59 is closed. Therefore, fluid can no longer pass through the lower portion of the whipstock assembly 57. With the gate 65 closed, and the reamer shoe 73 no longer rotating, the whipstock assembly 57 sets. This is achieved by the whipstock anchor 75 digging into the casing 33 of the wellbore 3 and the whipstock packer 77 expanding until the wellbore 3 is sealed.

FIG. 14 shows the system subsequent to the milling assembly 41 milling the new wellbore 45 according to one or more embodiments of the present invention. After the whipstock assembly 57 is set, a downward force is applied to the drill string 7 from the surface 31, thereby shearing the shear bolt 111 that connected the milling assembly 41 to the whipstock assembly 57. The shear bolt 111 utilized is selected such that shear force required to shear the shear bolt 111 is greater than any downward force placed on the system from the surface 31 while reaming the obstructions 113 in the wellbore 3. Subsequently, the milling assembly 41 is free to begin milling and is guided by the deflection surface 39 of the whipstock 37. The milling assembly 41 mills through the casing 33 of the wellbore 3 and into the formation 5 creating the new wellbore 45 parallel to the deflection surface 39 until a new desired depth is reached. The new wellbore 45 is formed at an angle to the wellbore 3 in order to avoid subsurface hazards, reuse of an existing wellbore 3 that has depleted reservoir production, or for a number of reasons that are not specifically described but would be understood to a person skilled in the art.

Figure 15:
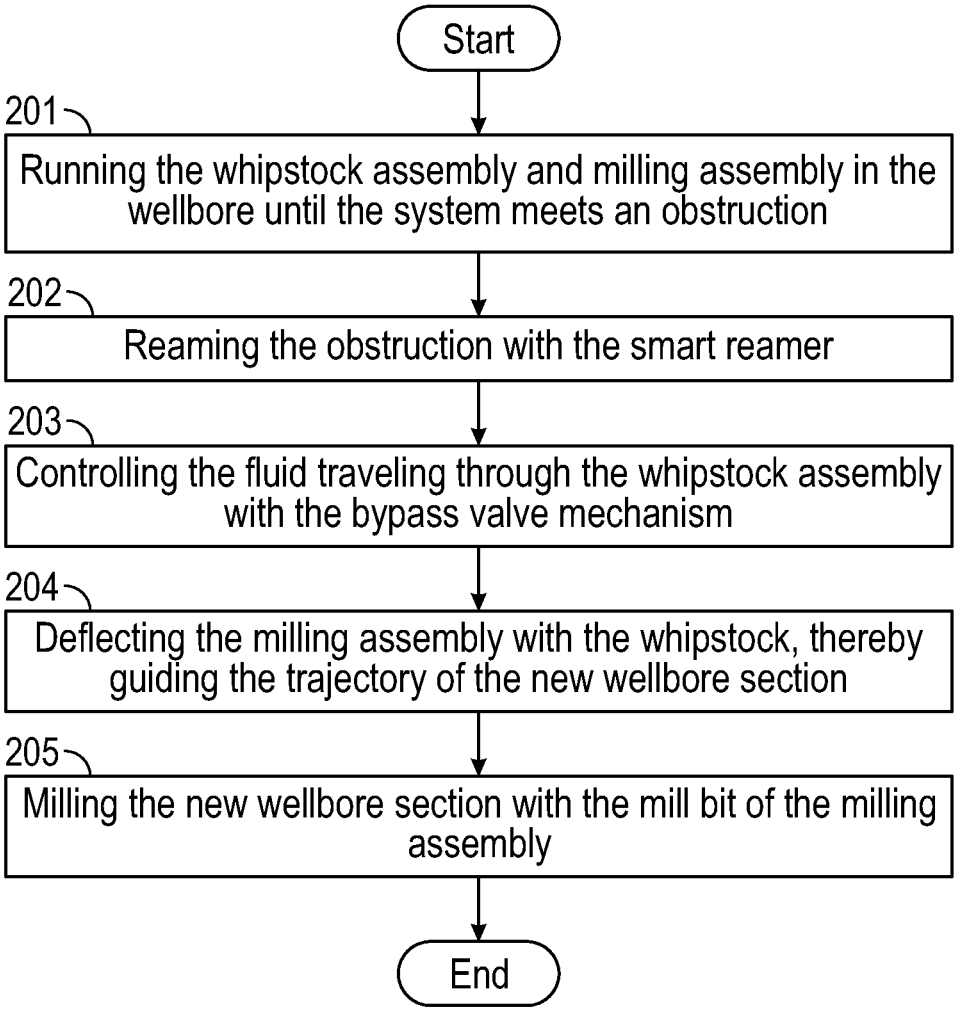
FIG. 15 shows a flowchart of a method in accordance with one or more embodiments of the present disclosure.

FIG. 15 depicts a flowchart showing a method of reaming an obstruction 113 in a wellbore 3 with a smart reamer 61 and subsequently milling a new wellbore 45 section. While the various flowchart blocks in FIG. 15 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In block 201, the whipstock assembly 57, connected to the milling assembly 41, is run into the wellbore 3. The whipstock assembly 57 and milling assembly 41 are connected to each other by the shear bolt 111 and are lowered in the wellbore 3 until the whipstock assembly 57 meets an obstruction 113. If no obstruction 113 is met, the whipstock assembly 57 is set at the desired depth.

In block 202, the smart reamer 61 reams through the obstruction 113 in the wellbore 3. Subsequent to the whipstock assembly 57 encountering the obstruction 113, a downward force from the surface 31 is pressed against the system, thereby pushing the reamer shoe 73 of the smart reamer 61 against the obstruction 113. In turn, whipstock assembly 57 continues to be lowered within the wellbore 3 while the mandrel 69 of the smart reamer 61 compresses the spring 71 within the inner casing 81. Simultaneously, the outer casing 83 slides along the exterior of the inner casing 81 such that more of the inner casing 81 is disposed within the outer casing 83 than in the relaxed position.

While the mandrel 69 travels upwards within the inner casing 81, the plurality of pins 89 of the upper pin ring 85 and the lower pin ring 86 interact with the grooves 88 of the mandrel 69, thereby rotating the mandrel 69. That is, the interaction between the plurality of pins 89 and the grooves 88 of the mandrel 69 converts the linear motion of the mandrel 69 into rotational torque. As such, the mandrel 69 rotates the reamer shoe 73, thereby permitting the reamer shoe 73 to ream through the obstruction 113.

When the system is raised away from the obstruction 113 within the wellbore 3, the force against the reamer shoe 73 decreases and the spring 71 begins to expand. While the spring 71 expands, the spring 71 moves the mandrel 69 in a downhole direction within the inner casing 81. As a result, the outer casing 83 also moves in the downhole direction with the mandrel 69. While the mandrel 69 is moved by the spring 71 in the downhole direction, the plurality of pins 89 interact with the grooves 88 of the mandrel 69, thereby continuing to rotate the mandrel 69, and thus, the reamer shoe 73, in the same direction. A number of cycles may be completed until the desired depth of the system is reached.

In block 203, fluid is pumped into the drill string 7 of the milling assembly 41 from the surface 31 while the smart reamer 61 reams the obstruction 113 or subsequent to the whipstock assembly 57 reaching the desired depth. The fluid is transported from the milling assembly 41 to the whipstock assembly 57. Specifically, the fluid transfer line 109 transports the fluid out of the milling assembly 41 and into the opening of the upper end of the whipstock 37. The fluid continues to flow downward through the whipstock 37 and into the bypass valve mechanism 59. The gate 65 of the bypass valve mechanism 59 is in the open position until the whipstock 37 is set, thereby facilitating the passage of fluid through the plurality of valve openings 63 of the bypass valve mechanism 59.

The fluid flows from the bypass valve mechanism 59 into the wellbore 3 by passing through the plurality of valve openings 63. This is facilitated by the gate 65 being in the open position. From the wellbore 3, the fluid flows back up to the surface 31. Further, the fluid lifts the debris 115 from the reamed obstruction 113 to the surface 31.

Subsequent to the wellbore 3 being cleared of debris 115 or the desired depth being reached by the whipstock assembly 57, a variable control pressure nozzle reduces the pressure of the fluid. When the pressure measurement of the fluid falls below the specified requirement, the gate 65 of the bypass valve mechanism 59 closes the plurality of valve openings 63. This, in turn, creates a pressure reaction on the piston 79 of the whipstock assembly 57, thereby setting the whipstock anchor 75 and expanding the whipstock packer 77. As the whipstock anchor 75 sets, the whipstock anchor 75 digs into the casing 33 of the wellbore 3 until the whipstock assembly 57 is secured.

In block 204, subsequent to the whipstock assembly 57 setting in the wellbore 3, a downward force is applied onto the milling assembly 41 from the surface 31. The force is great enough to detach the milling assembly 41 from the whipstock assembly 57 by shearing the shear bolt 111 temporarily holding the milling assembly 41 and the whipstock assembly 57 together. Once detached, the milling assembly 41 retracts upwards in the wellbore 3, away from the whipstock assembly 57, and begins to rotate the mill bit 11. Once the mill bit 11 begins to rotate, the milling assembly 41 is lowered back down to create a new wellbore 45.

In block 205, as the milling assembly 41 is lowered, the deflection surface 39 of the whipstock assembly 57 alters the trajectory of the milling assembly 41, guiding the milling assembly 41 at an angle away from the wellbore 3. The mill bit 11 is designed to mill through the casing 33 and creates a new wellbore 45 section external to the wellbore 3.

Accordingly, the aforementioned embodiments as disclosed relate to systems and methods useful for both reaming an obstruction 113 in a wellbore 3 with a smart reamer 61 and milling a new wellbore 45. The disclosed systems and methods advantageously run the whipstock 37 safely to the desired depth without any additional cleanout trips. This benefit, in turn, advantageously reduces additional rig time and associated costs. In addition, disclosed systems and methods generate an effective amount of rotational torque without employing a hydraulically driven reamer shoe 73 or the need to rotate the entire system. Furthermore, the reciprocating linear motion and rotation of the disclosed systems and methods advantageously aide in removing debris 115 within the wellbore 3, thereby preventing the system from getting stuck or prematurely setting at an undesired setting depth.

Although only a few embodiments of the invention have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A system comprising:

a milling assembly comprising a mill bit and a drill string configured to mill a new wellbore section; and a whipstock assembly comprising:

a reamer configured to ream an obstruction in a wellbore, wherein the reamer comprises a mandrel connected to a reamer shoe, the mandrel being configured to rotate the reamer shoe;

a whipstock configured to deflect the milling assembly away from the wellbore; and a bypass valve mechanism configured to control a fluid flowing through the system;

wherein the milling assembly is fluidly connected to the whipstock assembly.

2. The system according to claim 1, wherein the bypass valve mechanism comprises:

a gate;

an inner spring; and a plurality of valve openings;

wherein the gate is configured to close the plurality of valve openings when a force is applied on the inner spring.

3. The system according to claim 1, wherein the whipstock assembly further comprises:

a whipstock anchor;

a whipstock packer; and an anchor connection configured to connect the whipstock and the whipstock anchor.

4. The system according to claim 1, wherein the bypass valve mechanism and the reamer are sequentially aligned on a same vertical axis.

5. The system according to claim 1, wherein the milling assembly is attached to the whipstock assembly by a shear connection.

6. The system according to claim 3, wherein the whipstock anchor is fluidly connected to the bypass valve mechanism.

7. The system according to claim 1, wherein the reamer shoe is rotated by the mandrel in a single direction.

8. The system according to claim 1, wherein the reamer shoe comprises a convex shape configured to enable ledge-riding.

9. The system according to claim 7, wherein the mandrel is embodied as a double helical gear or a herringbone gear.

10. The system according to claim 7, wherein the smart reamer further comprises:

a spring;

a plurality of pins disposed within an inner casing of the reamer, the plurality of pins being configured to rotate the mandrel in response to the spring moving the mandrel axially within the inner casing of the reamer; and an outer casing fixed to an end of the mandrel, the outer casing being configured to slide over the inner casing in response to the mandrel moving axially within the inner casing.

11. A method comprising:

running a whipstock assembly fluidly connected to a milling assembly into a wellbore to a desired depth;

reaming, by a reamer of the whipstock assembly, an obstruction in the wellbore;

compressing a spring of the reamer by a mandrel of the reamer upon a reamer shoe of the reamer encountering the obstruction in the wellbore, thereby rotating the mandrel and the reamer shoe to ream through the obstruction in the wellbore;

controlling, by a bypass valve mechanism of the whipstock assembly, a fluid traveling through the whipstock assembly;

deflecting, by a whipstock of the whipstock assembly, the milling assembly away from the wellbore; and milling, by a mill bit of the milling assembly, a new wellbore section away from the wellbore.

12. The method according to claim 11, further comprising expanding the spring of the reamer as a result of the whipstock assembly and milling assembly being raised in the wellbore, thereby moving the mandrel downhole in the reamer and rotating the mandrel and the reamer shoe.

13. The method according to claim 11, further comprising transporting the fluid from a surface of the wellbore to the bypass valve mechanism by a drill string of the milling assembly.

14. The method according to claim 13, further comprising controlling a pressure in the bypass valve mechanism by a variable pressure control nozzle.

15. The method according to claim 14, further comprising lowering a gate to close a plurality of valve openings of the bypass valve mechanism when a pressure measurement of the fluid is below a specified requirement.

16. The method according to claim 15, further comprising creating a pressure reaction on a piston of a whipstock anchor and a whipstock packer of the whipstock assembly by closing the gate of the bypass valve mechanism, thereby setting the whipstock assembly in the wellbore.

17. The method according to claim 16, wherein setting the whipstock assembly further comprises anchoring the whipstock assembly in the wellbore with the whipstock anchor and expanding the whipstock packer to seal the wellbore.

18. The method according to claim 17, further comprising milling the new wellbore section subsequent to setting the whipstock assembly, detaching the milling assembly from the whipstock assembly, and deflecting the milling assembly from a deflection surface of the whipstock.

* * * * *